US008154423B2

(12) United States Patent
Wiseman

(10) Patent No.: US 8,154,423 B2
(45) Date of Patent: Apr. 10, 2012

(54) TRAFFIC CONTROL SYSTEM

(76) Inventor: Jay Wiseman, Bountiful, UT (US)

( * ) Notice: Subject to any disclaimer, the term of this patent is extended or adjusted under 35 U.S.C. 154(b) by 1548 days.

(21) Appl. No.: 11/113,885

(22) Filed: Apr. 25, 2005

(65) Prior Publication Data

US 2005/0190075 A1 Sep. 1, 2005

Related U.S. Application Data

(63) Continuation of application No. 10/348,032, filed on Jan. 21, 2003, now abandoned, which is a continuation-in-part of application No. 10/194,389, filed on Jul. 12, 2002, now abandoned.

(60) Provisional application No. 60/351,051, filed on Jan. 22, 2002.

(51) Int. Cl.
*G08G 1/095* (2006.01)
*G08B 5/00* (2006.01)

(52) U.S. Cl. ..... 340/907; 340/4.1; 340/332; 340/815.4; 340/815.65; 116/63 R

(58) Field of Classification Search ..... 340/906–908, 340/916, 321, 825.19, 815.4, 815.47, 815.65, 340/815.66, 815.73, 815.45; 362/800, 806; 116/63 R, 63 P; 40/564, 581
See application file for complete search history.

(56) References Cited

U.S. PATENT DOCUMENTS

| | | | | |
|---|---|---|---|---|
| D85,143 | S | 9/1931 | Adler, Jr. | |
| 1,988,633 | A * | 1/1935 | Sibley | 340/907 |
| 2,219,092 | A * | 10/1940 | Hoover | 362/242 |
| 2,228,835 | A * | 1/1941 | Leppert | 362/242 |
| 4,214,168 | A * | 7/1980 | Kulka | 362/540 |
| 5,898,381 | A * | 4/1999 | Gartner et al. | 340/815.65 |

* cited by examiner

*Primary Examiner* — Donnie Crosland
(74) *Attorney, Agent, or Firm* — Kunzler Needham Massey & Thorpe

(57) ABSTRACT

A traffic control system utilizes geometric or mathematical designs and/or secondary lights for traffic signals so as to allow red/green color blind individuals to determine whether the signal is for stop or go.

21 Claims, 20 Drawing Sheets caution do not turn caution-do not turn do not turn caution/do not turn caution caution no turn different arrow caution or do not turn do not turn no turn do not go turn no turn stop do not go do not turn caution no turn caution do not turn stop do not turn go stop caution do not turn

TRAFFIC CONTROL SYSTEM

RELATED APPLICATIONS

The present application is a continuation of U.S. patent application Ser. No. 10/348,032, filed Jan. 21, 2003, now abandoned which is a continuation-in-part of U.S. patent application Ser. No. 10/194,389, filed Jul. 12, 2002, now abandoned expressly incorporated herein, which claims priority to U.S. Provisional Patent Application No. 60/351,051, filed Jan. 22, 2002, expressly incorporated herein.

BACKGROUND OF THE INVENTION

1. Field of the Invention

The present invention relates to a traffic control system. More particularly, the present invention relates to the use of geometric and mathematic shapes or light color combinations, to make traffic control signals easier to read for persons who are red/green color blind or who are otherwise challenged or handicapped in their ability to distinguish certain colors.

2. State of the Art

In virtually all cities having more than a few hundred residents, it is common to have one or more traffic signals to indicate to a driver when he can proceed through an intersection and when he must stop. The most common arrangement for such traffic signals is to have a red light, a yellow light, and a green light. In a typical configuration, the red light is disposed on top, the yellow light in the middle, and the green light at the bottom.

In addition to such configurations, there are also numerous other configurations in which the lights are disposed in a horizontal array or in which a plurality of lights are used to signal that a driver may or may not turn during a given period of time. Furthermore, some locations use a single light which changes color depending on whether the driver is allowed to proceed.

For most individuals, the use of red, yellow, and green lights is very convenient. The color contrast between the colors clearly warns the driver of what he may or may not do. Even less common arrays of light, such as horizontally disposed arrays or arrays having color turn arrows are highly practical for most drivers.

There are, however, a large number of drivers for which the current signal system is frustrating and even dangerous. Millions of people around the world suffer from red/green color blindness. Such individuals have a difficulty or even a complete inability, to distinguish between the colors red and green. Thus, such individuals are unable, from the color, to determine whether they are being instructed to stop or to proceed.

Many with red/green color blindness compensate for the inability to distinguish between the stop and go signals by locating the position of the illuminated light. Thus, the driver may notice that the light is in the top circle thereby indicating stop, as opposed to being at the bottom and indicating that it is appropriate to proceed. When driving, this causes the driver to keep his eyes off the road for a longer then normal time to determine if it is permissible to proceed. Of course, drawing the driver's eyes off the road increases the risk that he might run into a car in front of his vehicle.

Even when the driver is stopped at an intersection, the inability to distinguish the two colors can raise problems. Unless the driver keeps his or her eyes focused on the light during the entire time waiting at an intersection, it takes a second or two for the driver to locate the signal and determine the location of the light. At night and other low ambient light conditions, it is very difficult to ascertain the locations of other non-lit signal lights. Thus, it can be very difficult to use the position method to verify red or green lights. The delay caused by trying to figure out the light position is often enough to cause embarrassment as drivers behind may begin honking if the light is green. This simply compounds the frustration and emotionally impacts the driver's decision making process. Additionally, if the driver makes a mistake, he or she may very well proceed through a red light mistakenly believing that the light is green.

These problems are significantly compounded, however, when a driver faces an unfamiliar light pattern. For example, in some locations having severe weather or height restrictions, the red, yellow, and green lights are disposed in a horizontal array on an overhead post, rather than in a vertical orientation. Thus, the red light may be on the far left and the green on the far right. However, if the driver is unfamiliar with the particular array, he or she is forced to guess as to wether it is the red or green light that is being illuminated, even if the driver can determine the position of the illuminated light. Thus, it is not uncommon to hear stories of color blind people who have traveled through an entire town passing through every red light, mistakenly believing that the light was green. Likewise, if the signal has multiple lights for indicating turning directions, a color blind driver may be unable to determine whether the signal or lighted arrow is red or green. Thus, the driver could turn in front of oncoming traffic causing a potentially fatal collision.

The effects of color blindness are even further exacerbated if the green light used is a color similar to lime green on the spectrum. To many red/green color blind people, lime green appears the same as the color yellow, because they only see the yellow portion of the yellow-green light. Thus, the driver may stop at an intersection when the light is green believing that the light has changed to yellow and that a red light is imminent. Of course, suddenly stopping at an intersection is both illegal and is likely to cause an accident.

Even if a red/green color blind or otherwise color challenged individual is able to determine which indication is being given, the additional challenge of determining location adds additional stress and time to the driver's decision making process, slowing down reaction time. This is particularly difficult where the driver is attempting to find his or her way in an unfamiliar city with unfamiliar traffic light orientations. If the driver turns to look at street markings, etc., he must reorient himself every few seconds to determine if a red light has changed to green, or vice versa.

Thus, there is a need for a traffic control system which enables people suffering from color blindness (or other vision problems) to readily determine if a signal indicates to proceed or stop without being able to determine the color of the light. Such a system should be easy to use and not interfere with the driving habits of those who do not suffer from red/green color blindness.

OBJECT AND SUMMARY OF THE INVENTION

It is an object of the present invention to provide an improved traffic control system which enables red/green color blind individuals to more accurately determine whether they are permitted to proceed or not without requiring them to determine the location of the light and thereby deduce whether it is red, yellow, or green.

It is another object of the present invention to form such a system which can be retrofit on existing traffic signals.

The above and other objects of the present invention are achieved in a traffic control system utilizing a plurality of lights with the visual portion thereof defining geometric shapes and/or color variations which thereby indicate whether the driver may proceed. It will be appreciated in light of the present disclosure that not all embodiments will meet each object of the invention. Rather the disclosed objects of the invention are merely desirable outcomes and should not be viewed as narrowing the claims.

In accordance with one aspect of the present invention, a red horizontally elongated shape is used in place of a conventional red circular light. The color red indicates to a conventional driver that he or she may not proceed. A horizontal nature of the light informs a red/green color blind person that he or she may not proceed without the individual being required to determine the location of the light.

In a preferred embodiment of this aspect of the invention, the red light is formed by a horizontal bar which is at least three times as long as it is high. The bar shape can be formed by either covering portions of a conventional incandescent traffic light or LED traffic light, or the LEDs can be arranged in two or three rows to form the horizontal bar. Because the bar is illuminated red, ordinary drivers are able to distinguish the color and stop. Because the light forms a horizontal bar, color blind drivers are also able to readily determine that the light is signaling a stop.

In accordance with another aspect of the invention, a green light is formed as to form a generally vertically extending bar. The green color of the light indicates to a typical driver that he or she may proceed, while the bar indicates to a red/green color blind individual that he or she may proceed. The green vertical bar can be formed by selectively covering traditional and LED traffic lights, or by using LEDs arranged in a vertical array.

By forming an LED light in which only about one-quarter of the surface area of the light is covered with LEDs, electricity consumption can be reduced by up to 75 percent. This is a further savings on the up to 90 percent electricity savings achieved by changing conventional traffic lights to LEDs. Thus, the cost of changing conventional bulbs can be readily recovered by a decrease in electricity bills by up to 97.5 percent.

In accordance with another aspect of the invention, the yellow light is provided with a shape, such as an inner circle to indicate that a driver must proceed with caution. The shape allows a red/green color blind person to clearly distinguish the yellow light, even if the green light is made up of a lime green or other green having a substantial yellow component to the color.

In accordance with another aspect of the present invention, one or more of the lights can be made with two colors. This is most easily done with an LED display. Thus, a light formed of substantially all red LEDs may have one or more white (or some other color) LEDs which give a visual signal identifiable to color blind individuals. Thus, the red light could have several white LEDs forming a circle, a horizontal bar, an X, etc., to warn color-blind drivers that the light is red. (Of course, this could also be done with the green light instead.) The white (or other color) portion of the light can also flash or blink while the red light (etc.) remains on to further alert both color blind and non-color blind drivers that they are to stop.

In accordance with another aspect of the present invention, a geometric design is added to a turn signal so as to clearly delineate that the turn signal is showing a stop or go arrow. In accordance with one embodiment of the invention, the turn signal is provided with a horizontal or vertical bar in conjunction with the arrow to thereby indicate that the driver must stop. (In other words, a bar parallel to the arrow shaft may signal to proceed, while a bar perpendicular to the arrow shaft may signal to stop.) In the alternative, the turn signal can be formed by a generally triangular indicator along with a generally vertical or horizontal bar for indicating when the driver should stop or proceed.

In accordance with still yet another aspect of the present invention, the different shapes and color combinations used to indicate stop, go and yield signals can be disposed in a single light and actuated so that the light shows only a single visual indication at a time. Thus, for example, a light could have a plurality of LEDs disposed thereon. One group of diodes would form a generally horizontal bar in the color red, indicative of stop. Another group of diodes on the same light would form a vertical bar in the color green, indicative of go. A plurality of yellow light emitting diodes could be disposed in other locations on the light to provide a yield signal. These light arrays may be overlapping or may simply be disposed on the same light in some predetermined configuration.

In accordance with still another aspect of the present invention, two of the conventional light colors could be combined to leave a traffic light having only two light signals. Thus, for example, yellow and green diodes could be placed on a light. When a go signal is indicated, the green LEDs would be lighted to provide an affirmative signal for go. Once the time had ended for the go signal, the green LEDs would be turned off and a plurality of yellow lights would be turned on to provide an affirmative yield signal. By combining the green and yellow lights, a failure by the green lights could, at worst, indicate for drivers to yield.

BRIEF DESCRIPTION OF THE DRAWINGS

The above and other objects, features and advantages of the invention will become apparent from a consideration of the following detailed description presented in connection with the accompanying drawings in which.

DETAILED DESCRIPTION

The invention will now be described so as to enable one skilled in the art to make and use the invention. It is to be understood that the following description is only exemplary of the principles of the present invention, and should not be viewed as narrowing the pending claims.

Figure 1:
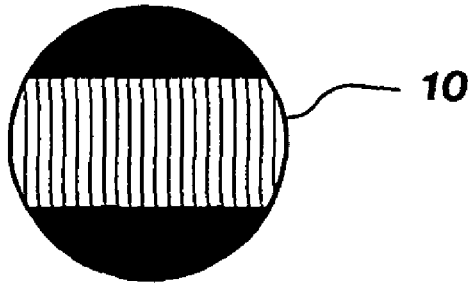
FIG. 1 shows a view of a red light configured in accordance with the principles of the present invention.
Figure 1A:
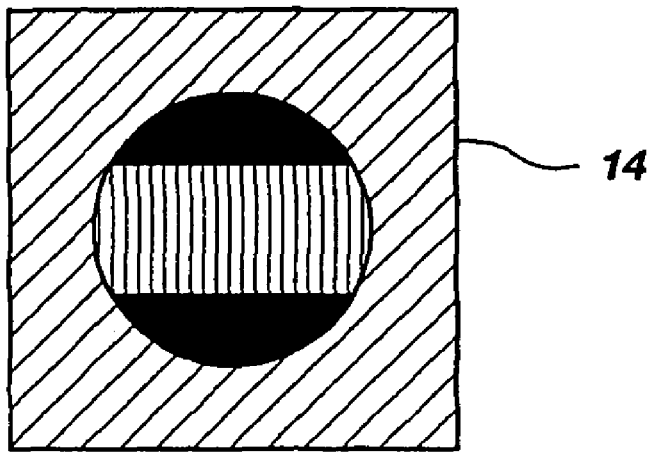
FIG. 1A shows a template for use on existing light structures to provide the desired geometric shape.

Referring to FIG. 1, there is shown a red light 10 configured in accordance with the principles of the present invention. The light is typically formed by either a bulb disposed behind a colored piece of glass, or a plurality of light emitting diodes disposed in an array. Unlike the prior art which teaches the conventional circular light which is visible to the driver, the light shown in FIG. 1 shows a geometric shape which is elongated so as to form a substantially horizontal bar.

The horizontal bar readily identifies to a person who is red/green color blind, that the light being shown indicates stop. Thus, regardless of the location of the light, a person suffering from color blindness can readily determine the instruction being provided by the traffic signal light. Such a signal will provide instantaneous recognition to the driver and thereby enable the driver to respond immediately to the signal without having to determine the location of the light.

The horizontal bar of the red light of FIG. 1 is made by darkening the typical circular light at the top and bottom extremes. Typically about ⅙th to ⅓rd of the distance from the top and from the bottom are darkened. Darkening the top and bottom ¼th of the diameter is preferred.

Figure 1B:
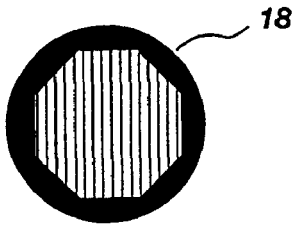
FIG. 1B shows an alternate embodiment of a red light when a geometric shape is an octagon.

Turning now to FIG. 1B, there is shown a template 14 which can be used with an existing light. The template is shaded so as to cover the top ¼th and the bottom ¼th of the diameter of the circle to thereby provide a generally horizontal bar. The template can be adhesively attached to the light, or can be mounted by other means. It will be appreciated from the present disclosure that the area of the stop light which is covered to block light could be tailored to provide optimal recognition. Presently it is believed that a horizontal line which is at least 3 to 4 times wider than it is high is the optimal, as it is easier to distinguish such a line from a distance.

Turning now to FIG. 1B, there is shown an alternate configuration of a stop light 18 made in accordance with the principles of the present invention. Instead of a horizontal bar, the stop light defines an octagon. Those skilled in the art will appreciate that an octagon is a common symbol for stop when used on non-illuminated signs. It is not generally used, however, with stop lights. By providing an octagon, the drive can tell by the shape that he must stop.

Figure 2:
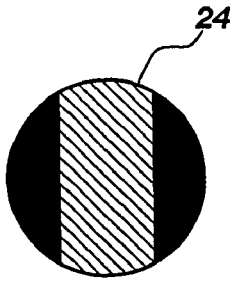
FIG. 2 shows a green light having a geometric design in accordance with the principles of the present invention.

FIG. 2 shows a green light 24 having a geometric design in accordance with the principles of the present invention. Rather than a horizontal bar or an octagon, the green light 24 has the sides of a circle filled in (typically between ⅙th and ⅜th of the diameter, and preferably between about ¼th and ⅓rd of the diameter on each side so that the resulting vertical bar is about 3 to 4 times as long as it is wide). This provides a generally vertical bar shape which can be seen and distinguished from a considerable distance. The vertical orientation of the bar shape is sufficiently different from the horizontal bar shown in FIG. 1, that a red/green color blind individual can readily determine that the he is able to proceed through the intersection. Furthermore, the shape allows the signal to be distinguished from a considerably greater distance than a color blind person could distinguish the light based on position within the light array.

Figure 3:
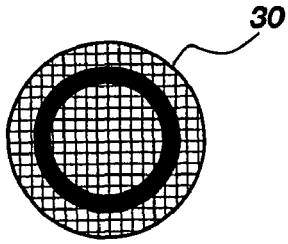
FIG. 3 shows a yellow light having a geometric design.

Turning now to FIG. 3, there is shown a yellow light 30 with a geometric shape formed thereon. As shown, the light 30 has a doughnut shaped blacked-out portion. It will be appreciated that numerous other shapes could also be used, such as a triangular shape, a Y shape, etc.

Figure 3A:
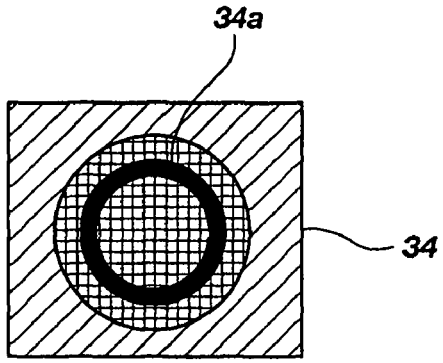
FIG. 3A shows a template for providing such a design on an existing light.

Turning now to FIG. 3A, there is shown a template 34 for providing the design shown in FIG. 3A. The template has a blacked-out portion 34*a* and a clear portion 34*b* to provide the blacked-out shape. As with the previous templates, template 34 can be adhesively attached to the light, can be formed as an integral part of the lens of the light or can be mounted in other ways which will be apparent to one skilled in the art.

Figure 4:
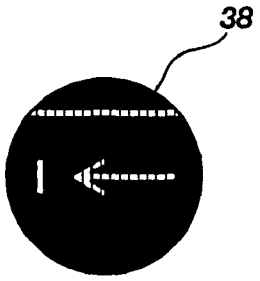
FIG. 4 shows a geometric design for use in association with a turn signal.

Turning now to FIG. 4 shows a geometric design for use in association with a turn signal 38 indicating stop. The geometric design includes an arrow, including an arrow head and a horizontal line, along with a pair of lines indicating that turning in the direction of the arrow is not allowed. As shown in FIG. 4, one line is a horizontal bar, similar to the stop signal discussed above. This horizontal bar may be placed above or below the entire arrow or only the arrow head. Also shown is a vertical bar blocking the direction of the arrow (i.e. perpendicular to the shaft of the arrow). Thus, regardless of the location of the light, the driver knows that he cannot proceed.

Figure 4A:
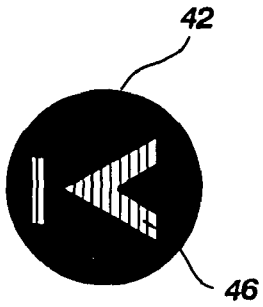
FIG. 4A shows an alternate design for a turn signal indicating stop.

FIG. 4A shows an alternate design for a turn signal 42 indicating stop. The turn signal 42 includes only a vertical bar blocking the path indicated by the arrow head 46. By placing a bar perpendicular to the shaft of the arrow head, it is clear to the driver that he may not proceed.

Figure 4B:
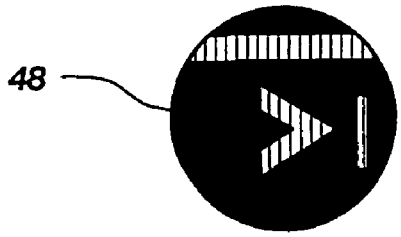
FIG. 4B shows an alternate embodiment of a geometric design indicating stop.
Figure 5:
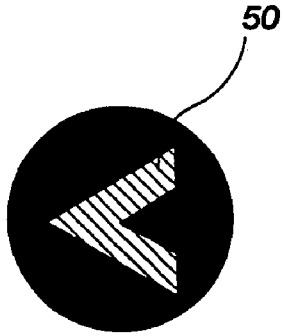
FIG. 5 shows a configuration for indicating a signal to proceed.
Figure 5A:
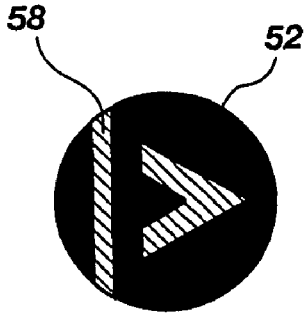
FIG. 5A shows yet another alternate embodiment for indicating that it is safe to proceed in conjunction with a turn signal.

FIG. 4B shows an alternate embodiment of a geometric design indicating stop similar to that discussed with regard to FIG. 4, only the arrow head 48 is used in place of a full arrow, and it is for turning in the other direction. And the vertical bar FIG. 5 shows a configuration for indicating a signal to proceed. The arrow is indicated by a green arrow head 50. Without a horizontal bar, or a bar in front of the arrow head 44, the driver knows that it is safe to proceed. Likewise, in FIG.

5A, the use of a vertical bar 58 behind the arrow head 52 can also be used to indicate that it is safe to proceed.

Figure 6:
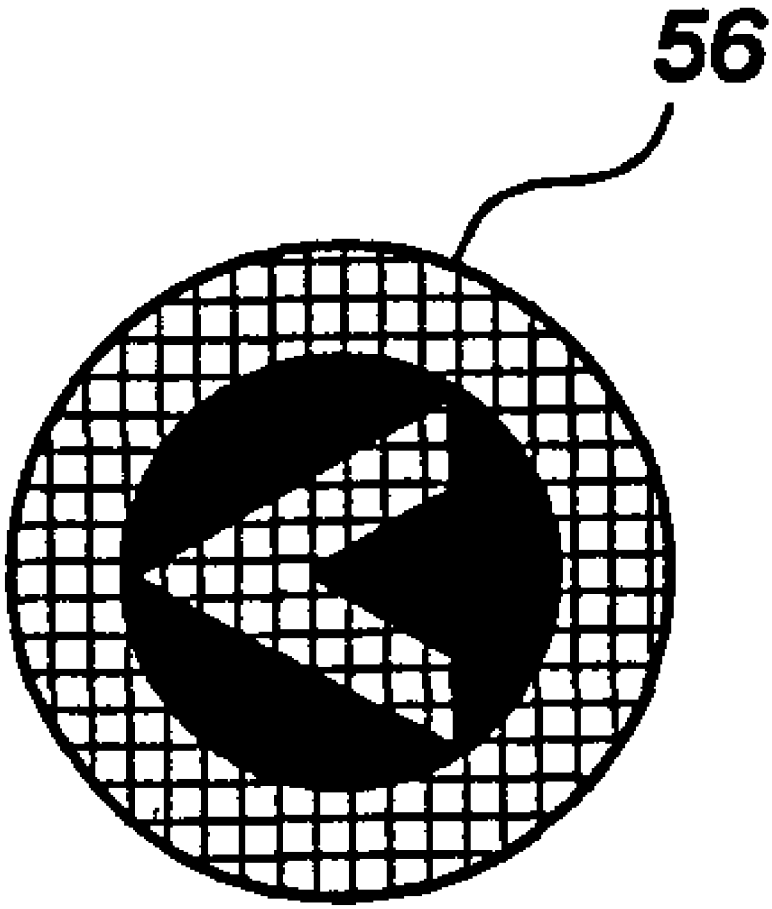
FIG. 6 shows yet another embodiment of the present invention.

FIG. 6 shows a yellow light configured 56 for indicating that the driver should make the turn with caution. Having the yellow arrow head inside of the yellow circle differentiates the yellow turn signal from those for red and green.

While discussed above primarily regarding conventional lighting systems, it will be appreciated that the method of the present invention would also relate to digital and projection lighting systems. For example, in the future a single display panel could be used for the stop signal, the yield/caution signal and the proceed signal. By having a geometric or other shape in conjunction with the color indicator, there will no longer be a need to rely on light position for red/green color blind individuals to determine whether to stop or proceed.

Figure 7A:
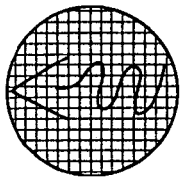
FIG. 7A through FIG. 7U shows a variety of other embodiments of the present invention for indicating caution, do not turn, stop, etc.
Figure 7B:
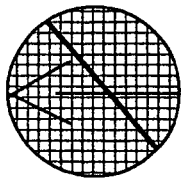
Figure 7C:
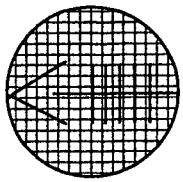
Figure 7D:
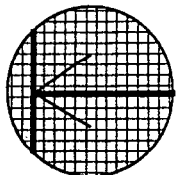
Figure 7E:
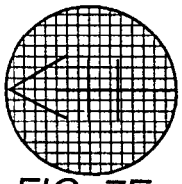
Figure 7F:
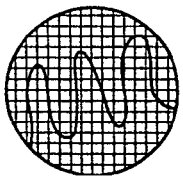
Figure 7G:
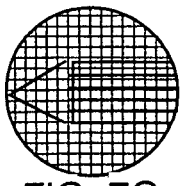
Figure 7H:
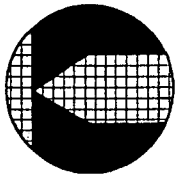
Figure 7I:
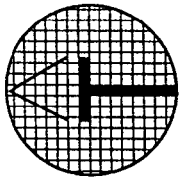
Figure 7J:
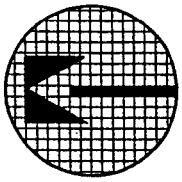
Figure 7K:
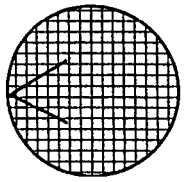
Figure 7L:
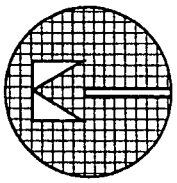
Figure 7M:
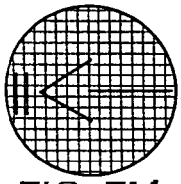
Figure 7N:
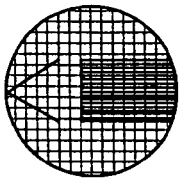
Figure 7O:
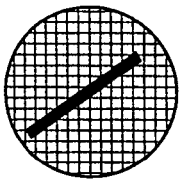
Figure 7P:
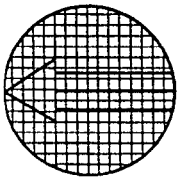
Figure 7Q:
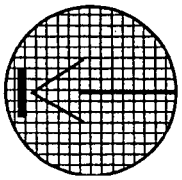
Figure 7R:
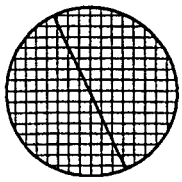
Figure 7S:
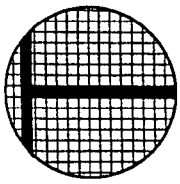
Figure 7T:
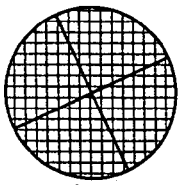
Figure 7U:
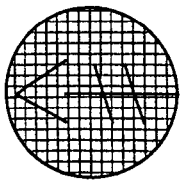

Turning now to FIG. 7A through FIG. 7U, there is are shown a variety of other shapes and designed designs which can be used to indicate that a driver may proceed with caution, should stop, etc. The designs allow a color blind person to determine whether or not he may proceed without determining the location of the light. This significantly reduces stress and improves reaction time for the color blind individual. Additionally, the different designs can even be used on a single light. For example, a light formed by light emitting diodes can provide three different designs from a single array of diodes. Not only can the diodes be arranged to emit different colors, the different designs enable a color blind individual to look at and quickly determine whether or not he may proceed.

Figure 8:
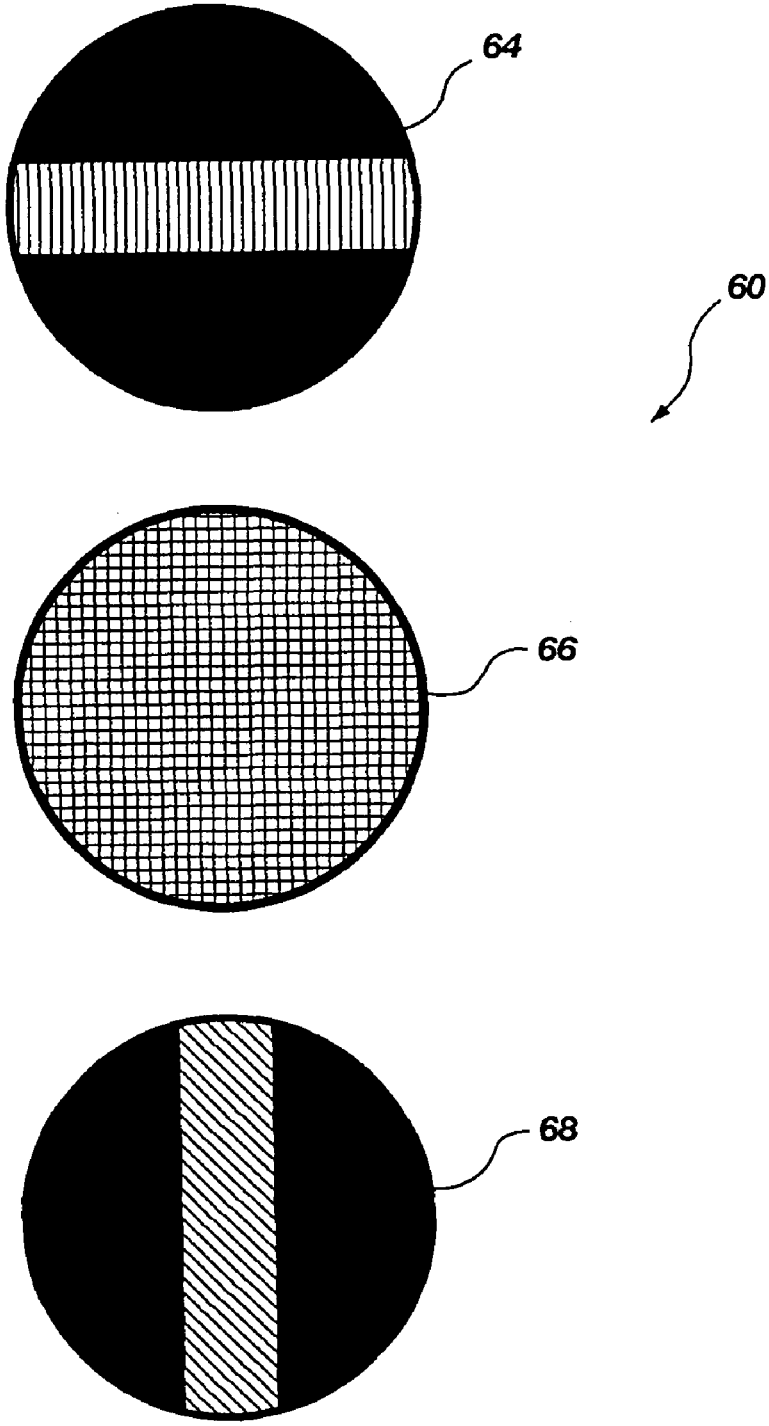
FIG. 8 shows a stop light array formed in accordance with another embodiment of the present invention.

Turning now to FIG. 8, there is shown a stop light array, generally indicated at 60, formed in accordance with another embodiment of the present invention. The stop light array 60 includes a first, red light 64, a second, yellow light 66 and a third, green light 68.

The first, red light 64 is configured so that the emitted light forms a horizontal red bar. The horizontal bar is preferably between three and eight times as long as it is tall. Most preferably, the length to height ration is about 4:1. In such a configuration, the red light 64 forms a bright red line which can be distinguished by color or shape from a substantial distance. Thus, ordinary drivers can readily see the red, while color blind drivers can readily see the horizontal line.

Forming the red light 64 as shown in FIG. 8 is relatively simple. For existing lights, a cover can be provided to allow only the desired light pattern through. New lights can be formed using LEDs placed in two or three rows.

In addition to making it easier for color blind people to see the light, the red light 64 also substantially reduces the amount of electricity required. Many municipalities are switching to LED lights because they use about 90 percent less electricity than conventional bulbs. The present invention, can further reduce the about of electricity used by 60-75 percent, as a smaller area of the "light" is being illuminated. Thus, by switching from a conventional bulb to a bulb of the present invention, a power savings of up to 97.5 percent can be achieved. This can quickly cover the cost of installing the new lights. Additionally, the horizontal bar can be determined from a significantly greater distance by color blind people than can a conventional light because the color blind person need not determine the location of the light within the array. Thus, such a configuration is more cost effective, provides enhanced safety and more fully complies with laws governing disabilities.

FIG. 8 also shows the yellow light 66, which has been left its conventional shape, and the green light 68, which forms a vertical bar which is between 3 and 8 times as tall as it is wide. Preferably, the green, vertical bar is about 4 times as tall as it is wide. As with the red light 64, the green light 68 allows the signal to be distinguished by both color and configuration from a substantial distance. Those skilled in the art will appreciate, in accordance with the present invention, that the yellow light could also be provided with a shape other than a circle so that a color blind person would instantly recognized that an advanced traffic control system was being used even upon seeing just the yellow light.

Figure 9:
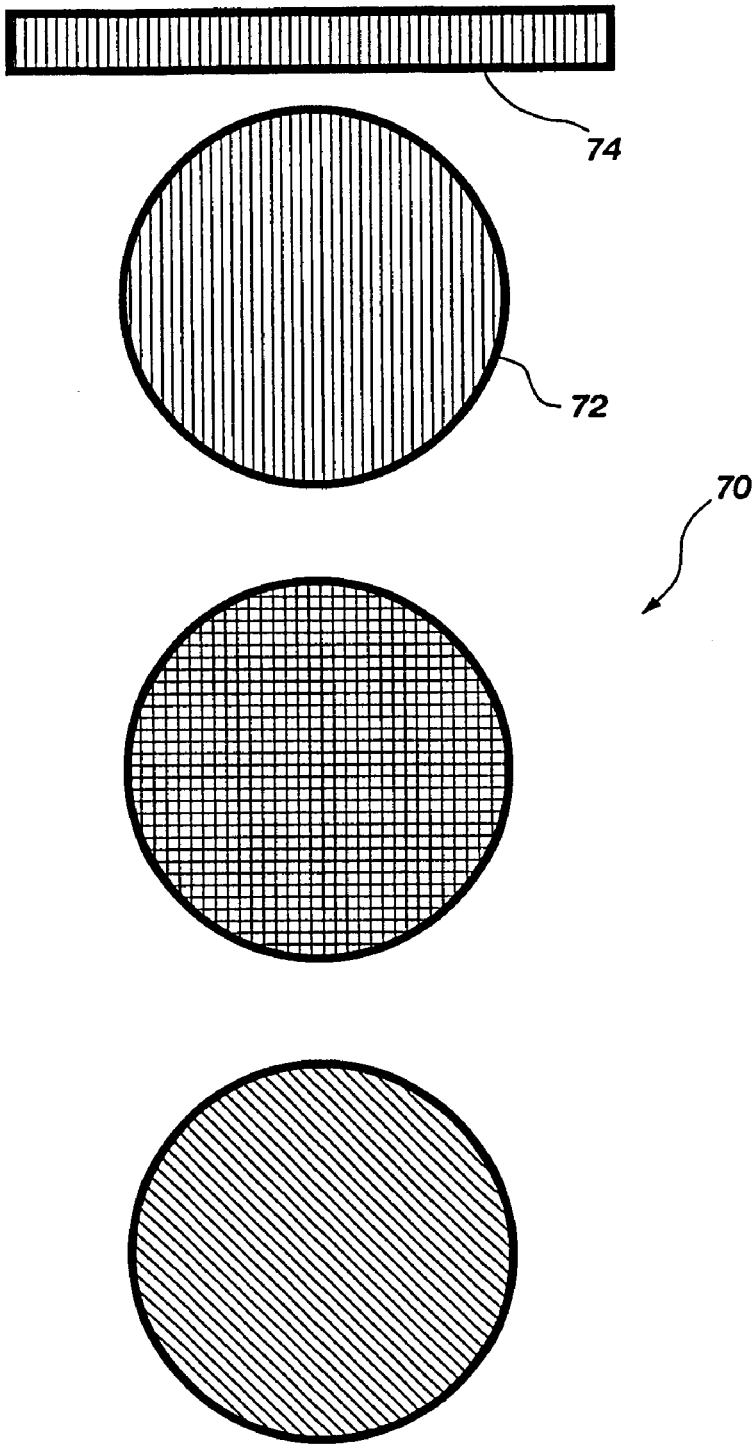
FIG. 9 shows a stop light array formed in accordance with another embodiment of the present invention.

FIG. 9 shows a stop light array, generally indicated at 70, formed in accordance with another embodiment of the present invention. The stop light array 70 includes a conventional red light 72 and a secondary red light 74 which is disposed adjacent to the conventional red light. The secondary red light 74 forms a horizontal bar which can be readily seen by color blind individuals.

The stop light array 70 is otherwise the same as traditional patterns. Thus, by simply adding the horizontal red light, a color-blind driver is able to quickly determine wether the light is indicating a stop.

Figure 10:
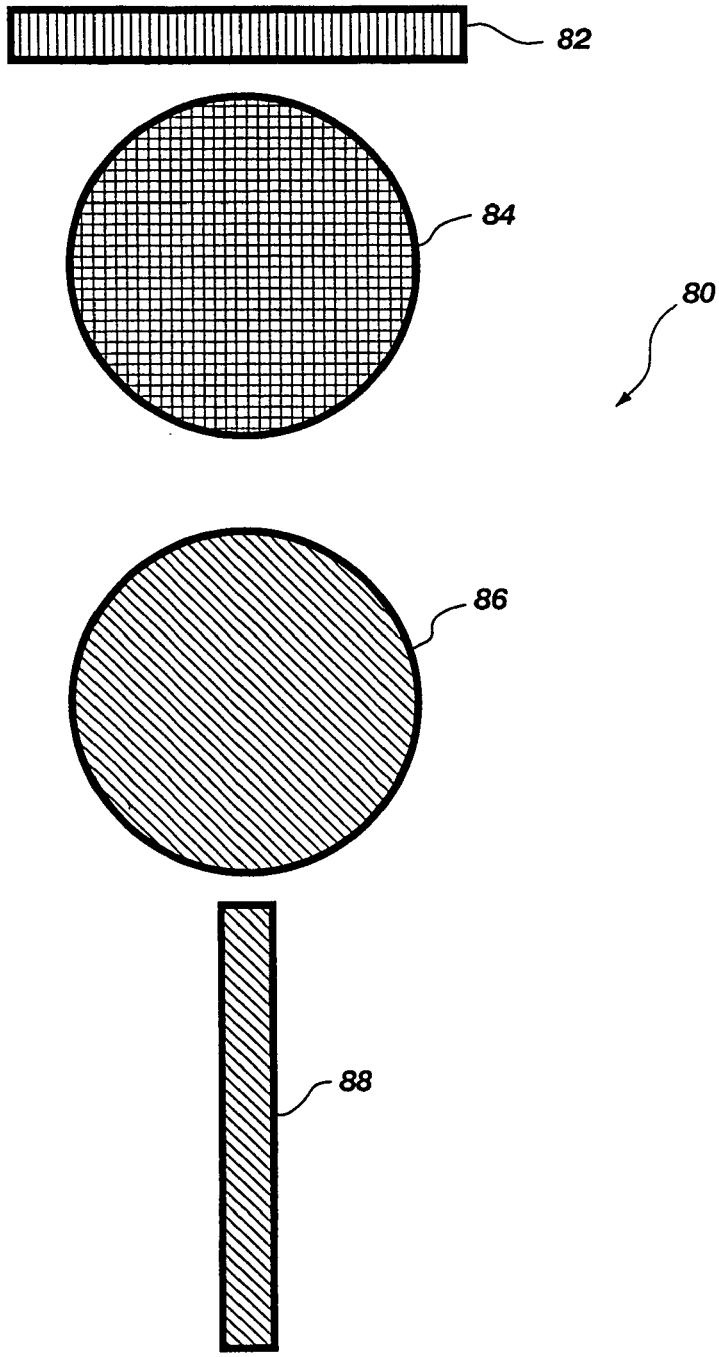
FIG. 10 shows yet another stop light array formed in accordance with the principles of the present invention.

FIG. 10 shows yet another stop light array, generally indicated at 80 formed in accordance with the principles of the present invention. The stop light array 80 includes a first, red light 82 forming a horizontal bar, a second, yellow light 84, a third, green light 86 and a fourth, secondary green light 88 forming a vertical bar. As with the previous embodiment, the vertical bar helps to indicate to color blind individuals that it is safe to proceed. It should be appreciated, of course, that the horizontal or vertical bar lights need not be the same color as the traditional bulb. Thus, the secondary light 84 could simply be white and/or could flash.

Figure 11:
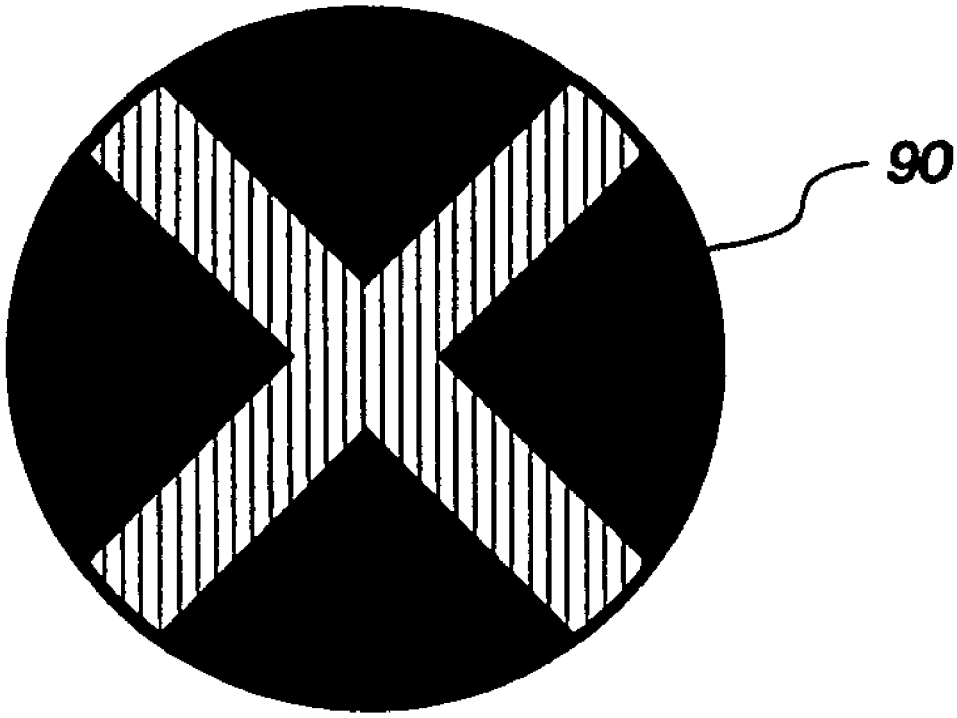
FIG. 11 shows a stop signal made in accordance with the principles of the present invention.

Turning now to FIG. 11, there is shown a stop signal 90. Rather than a horizontal bar, the stop signal forms a red X. The symbol X is a relatively universal signal indicating not to proceed with something. The X is preferably formed so that the width of the legs are each between ⅛ and ⅓ the diameter of the bulb. If the legs are much wider, it may be difficult from any appreciable distance to tell that an X is being formed, thereby limiting the ability of color blind drivers to quickly determine that a stop signal is being used.

As with previous embodiments, the X can be formed by using a cover over a conventional light. In the alternative, the X can be formed from an array of LEDs which are properly placed. While not as energy efficient as the embodiment in FIG. 8, the X shaped stop signal 90 will still use less electricity that either a conventional bulb or a common LED array.

Figure 12A:
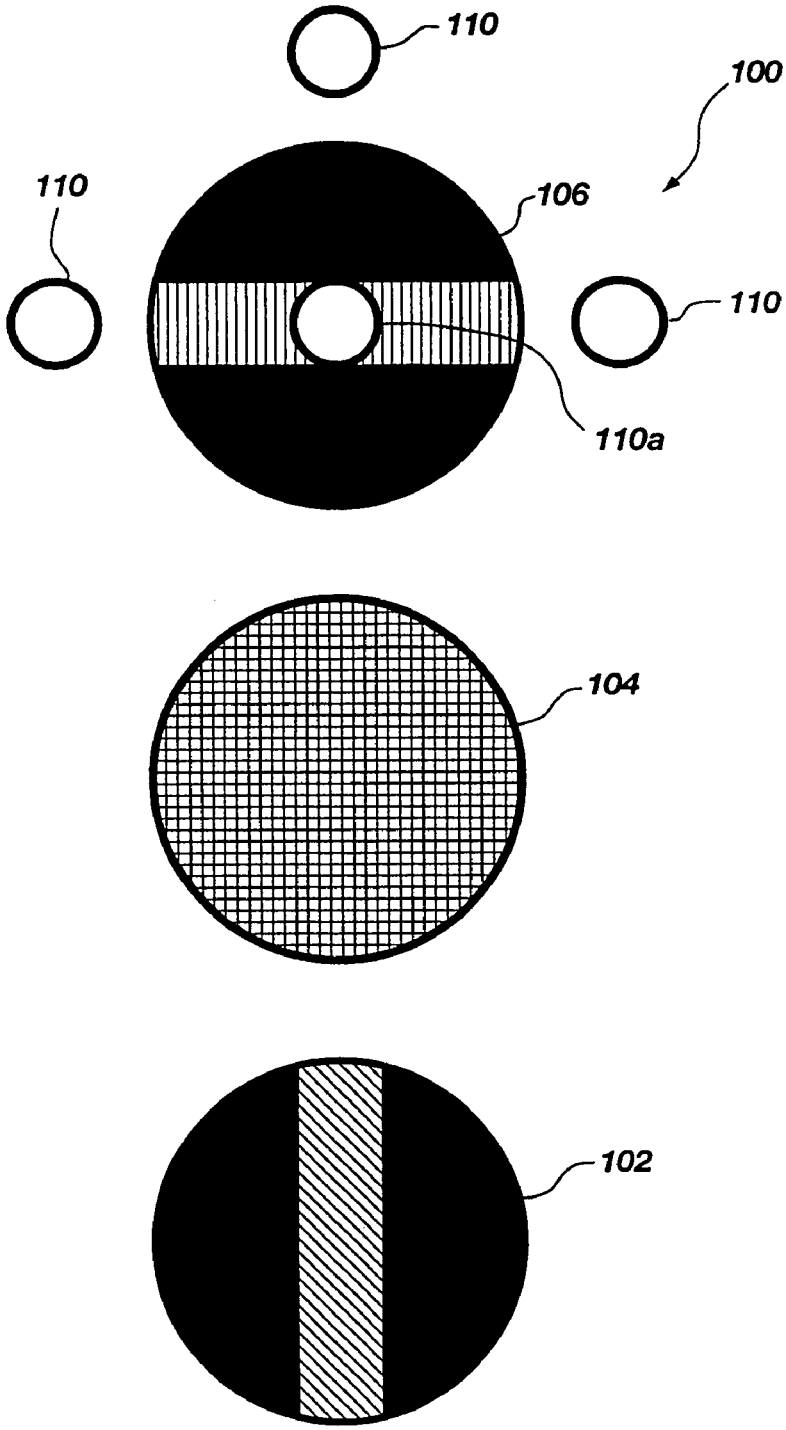
FIG. 12A shows a stop light array in accordance with the principles of the present invention.

Turning now to FIG. 12A, there is shown yet another a stop light array, generally indicated at 100, made in accordance with the principles of the present invention. The stop light array includes a green light 102 forming a vertical vertical bar, an a yellow light 104 forming a circle, and a red light 106 forming a horizontal red bar. A plurality of secondary lights 110 are disposed in or around the red light 106. Additionally, a secondary light 110*a* may be disposed in the center of the bar. These secondary lights 110 may be on continuously in conjunction with the primary light, or may flash or blink as an additional warning to all drivers. This is particularly so if the secondary light flashes while a red light is on—thereby alerting distracted drivers to pay attention to the stop signal.

While color blind individuals have a difficult time distinguishing between red and green, they usually have little difficulty distinguishing some other colors. Thus, by providing secondary lights 110 which are a color other than red or green, color blind people can readily determine if the light is green or red. As shown in FIG. 12A, the secondary lights are white. However, other colors could also be used. Additionally, the secondary light 110 disposed within the red light 106 can be formed by one or more non-red LEDs disposed as part of the array. Additionally, they can blink or flash or blink to provide an additional warning.

Figure 12B:
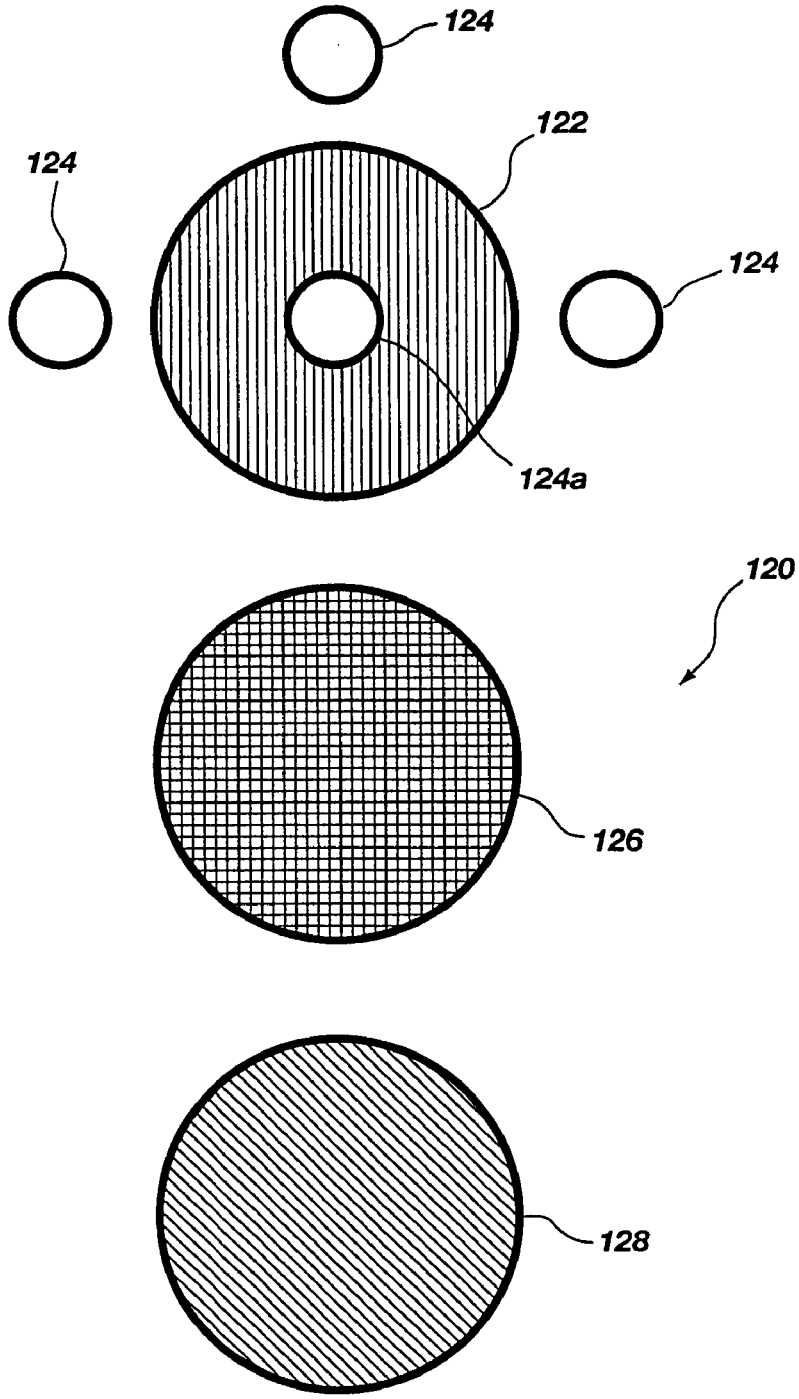
FIG. 12B shows a stop light array similar to that of FIG. 12A, but with a modified stop signal.

FIG. 12B shows an alternate embodiment of a stop light array, generally indicated at 120. The stop light array 120 is similar to the stop light array 100 of FIG. 12A, but with a modified stop signal. Instead of a horizontal red bar, the red light 122 is formed as a conventional red circle, with the exception of a secondary light 124*a*. The secondary light 124*a* can be formed by a plurality of LEDs disposed in the center of the red light 122, or by a single white light either formed by a light emitting diode as shown in FIG. 12B, or by a strobe or other conventional light.

To further emphasize the light, a plurality of secondary lights 124 can be disposed about the red light 122. Thus, it is easy to distinguish the red light 122 from a similarly shaped yellow light 126 and green light 128 without reliance on the color of the lights. Each light may also blink if desired.

Figure 12C:
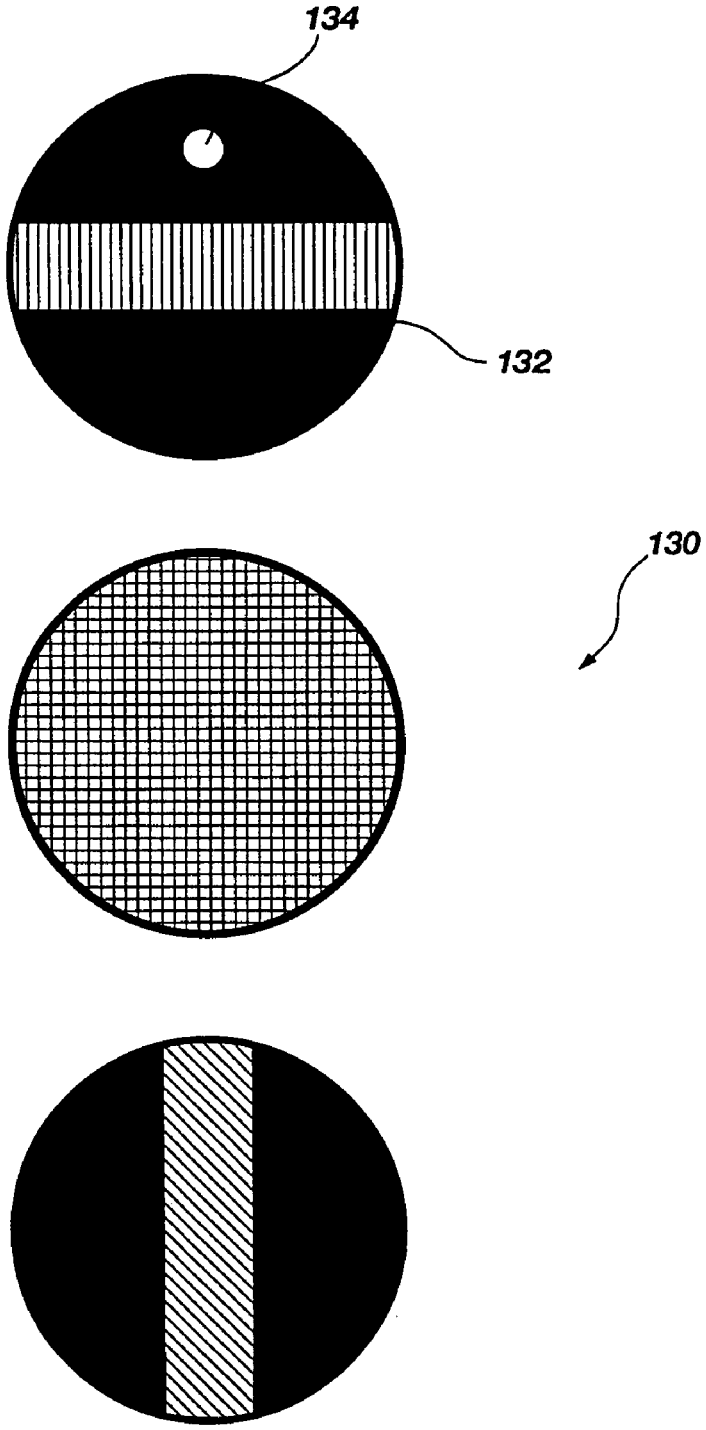
FIG. 12C shows another embodiment of a stop light array in accordance with the principles of the present invention.

It will be appreciated, that the red light could be configured in a variety of shapes, and have a secondary light formed a variety of configurations. Thus, the light array, generally indicated at 130 in FIG. 12C has a horizontal bar for the red light 132, and a white circle (typically an LED) for the secondary light 134 which is positioned in the black portion of the light. As mentioned previously, the light may flash of blink.

Figure 12D:
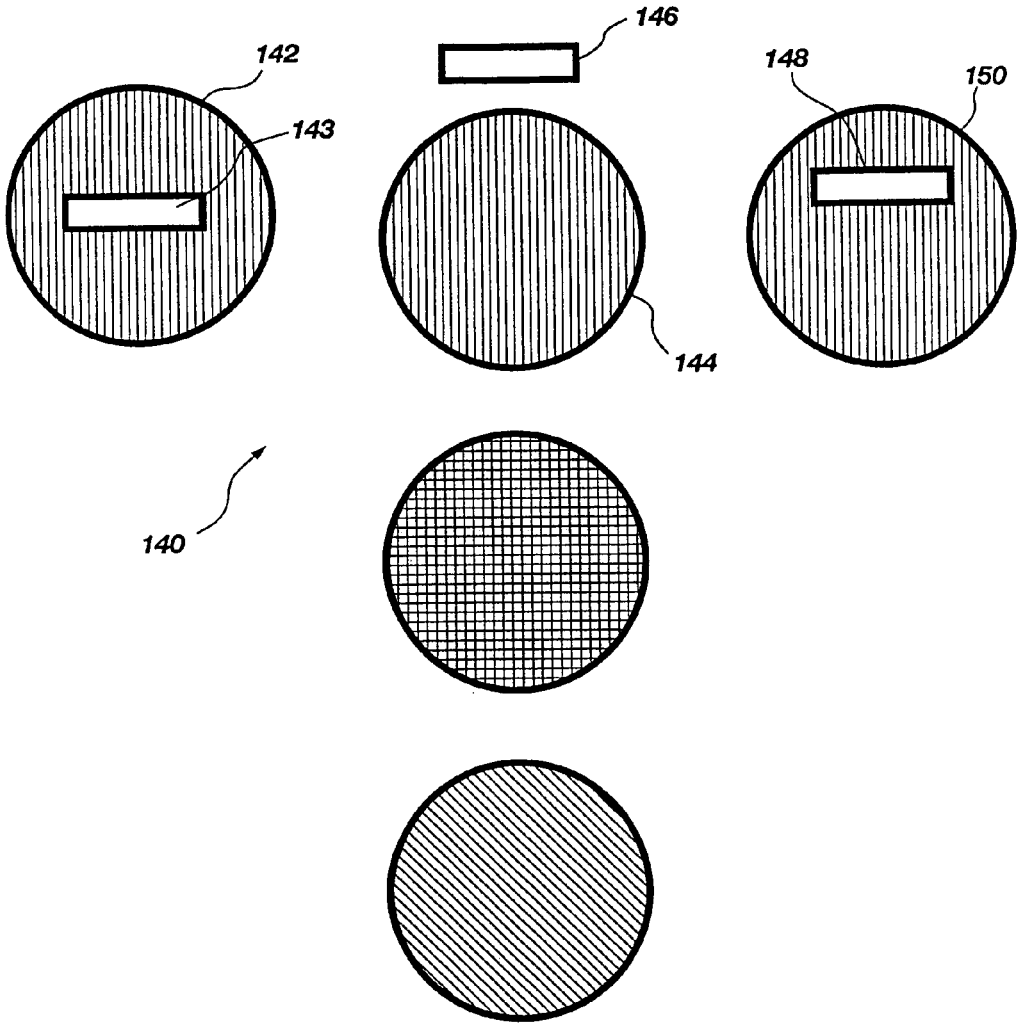
FIG. 12D shows other embodiments of stop light arrays in accordance with the principles of the present invention.

FIG. 12D shows a light array 140 with three different stop light configurations. The first is a circular red light 142 having a secondary light 143 which forms a horizontal bar within the light. The second red light 144 is a solid circle and has a horizontal secondary light 146 positioned above the red light. The third shows a secondary light 148 positioned in the red light 150, but above center. Of course, any of the three configurations could be used and the light could be constant or flashing.

Figure 12E:
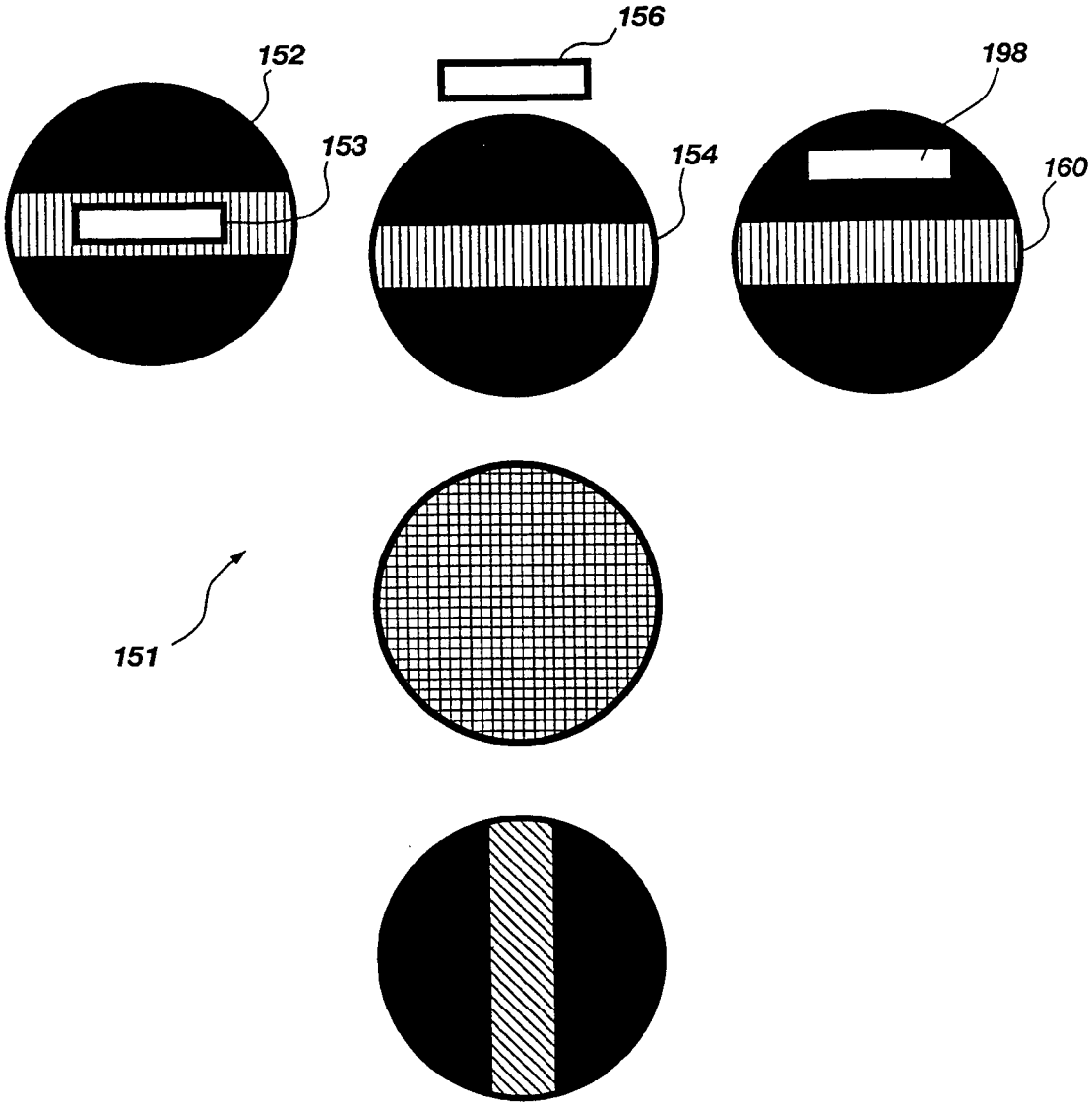
FIG. 12E shows yet other embodiments of stop light arrays in accordance with the principles of the present invention.

FIG. 12E shows a light array 150 similar to light array 140, but with the circular red lights replaced with red horizontal bars. Thus, the first red light 152 has the secondary light 153 disposed in the horizontal bar. The second red light 154 has the secondary light 156

Figure 12F:
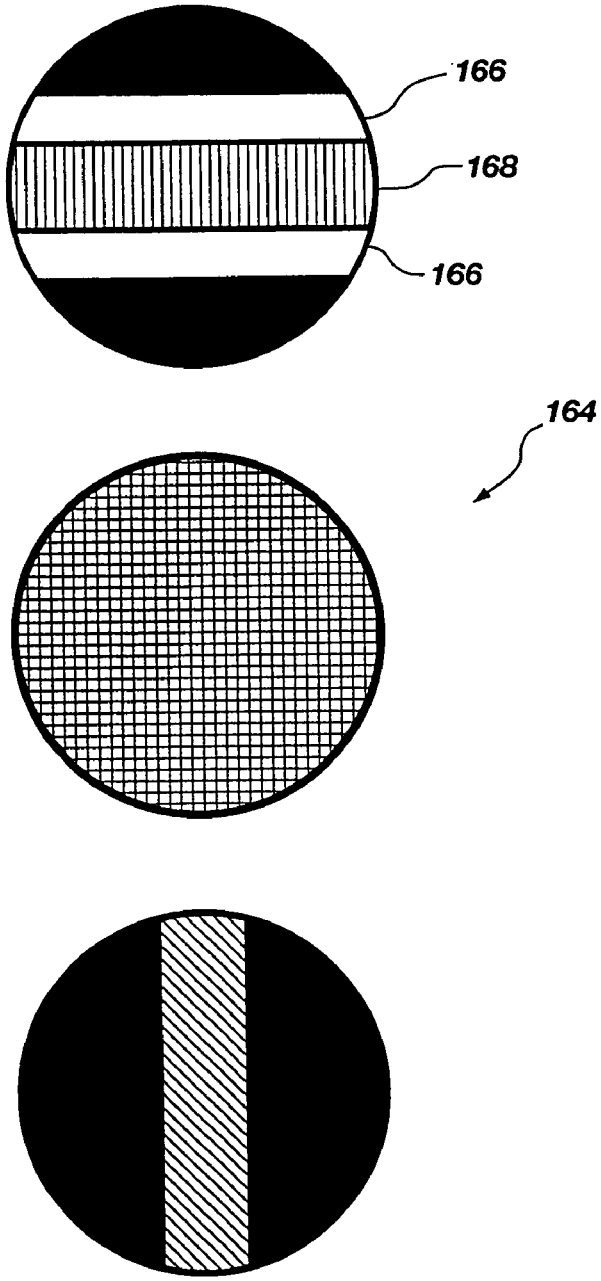
FIG. 12F shows yet another embodiment of a stop light array in accordance with the principles of the present invention.

FIG. 12F shows an alternate configuration of a light array, generally indicated at 164, with a pair of secondary lights 166 disposed on either side of the red horizontal bar 168.

Figure 12G:
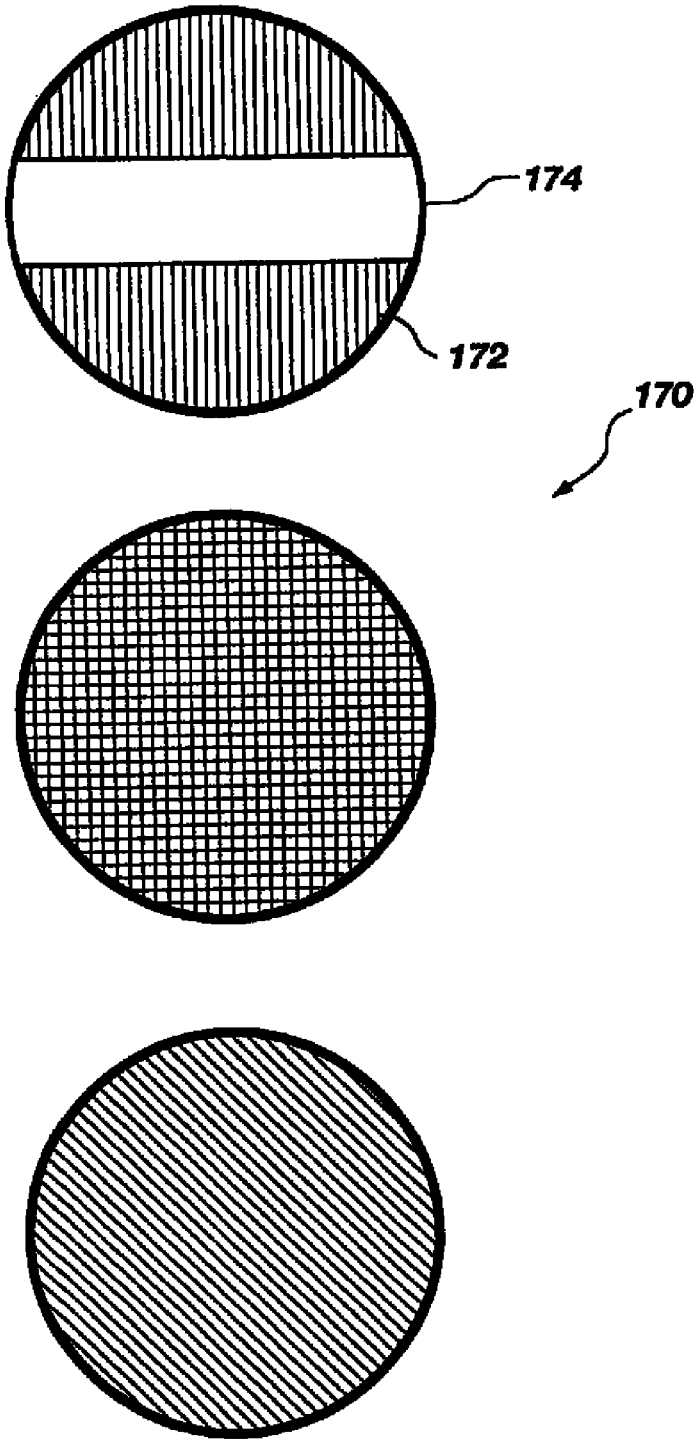
FIG. 12G shows still another embodiment of a stop light array in accordance with the principles of the present invention.

FIG. 12G shows still another configuration of a light array, generally indicated at 170, wherein the red light 172 is generally circular, and has a secondary light 174 in the form of a horizontal white bar. Those skilled in the art will appreciate that the two colors can be formed integrally in the glass of the lens, can be formed by selectively covering portions of a lens, or can be formed with a plurality of light emitting diodes, which are individually colored.

Figure 12H:
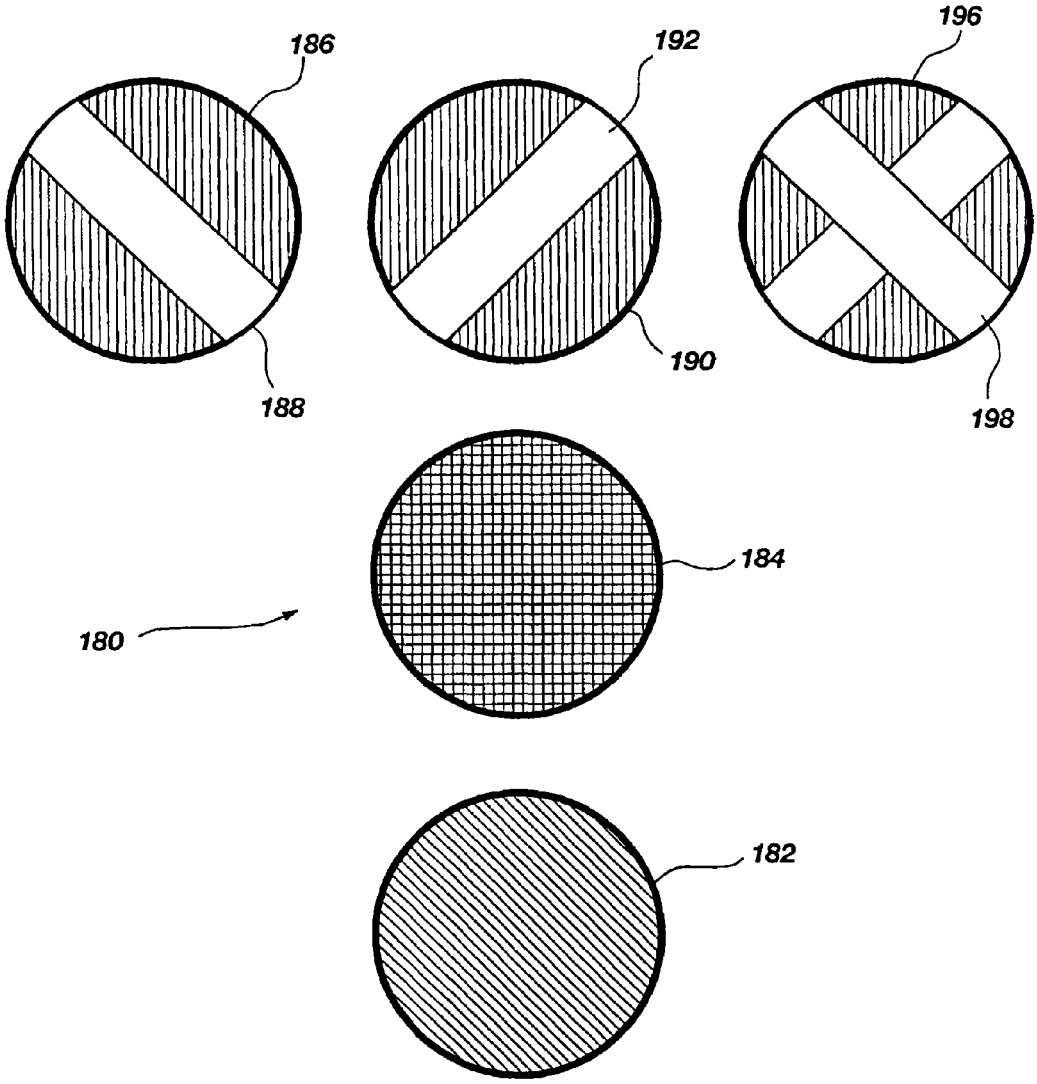
FIG. 12H shows still other embodiments of stop light arrays in accordance with the principles of the present invention.

Turning now to FIG. 12H, there is shown yet another light array, generally indicated at 180. The light array includes a green light 182 and a yellow light 184. Those skilled in the art will appreciate that these lights can be conventional round lenses as shown, or can be vertical bars, etc.

Also shown are three different configurations for red lights. The first red light 186 includes a white bar 188 disposed extending downwardly to the right. The second red light 190 includes a white bar 192 extending upwardly to the right. The third red light 196 includes overlapping white bars 198 which form a white X in the red light. Those skilled in the art will appreciate that any of the three red lights (186, 190 or 196) can be used to clearly indicate to color blind drivers that the signal they are seeing indicates that they must stop the vehicle.

Figure 13:
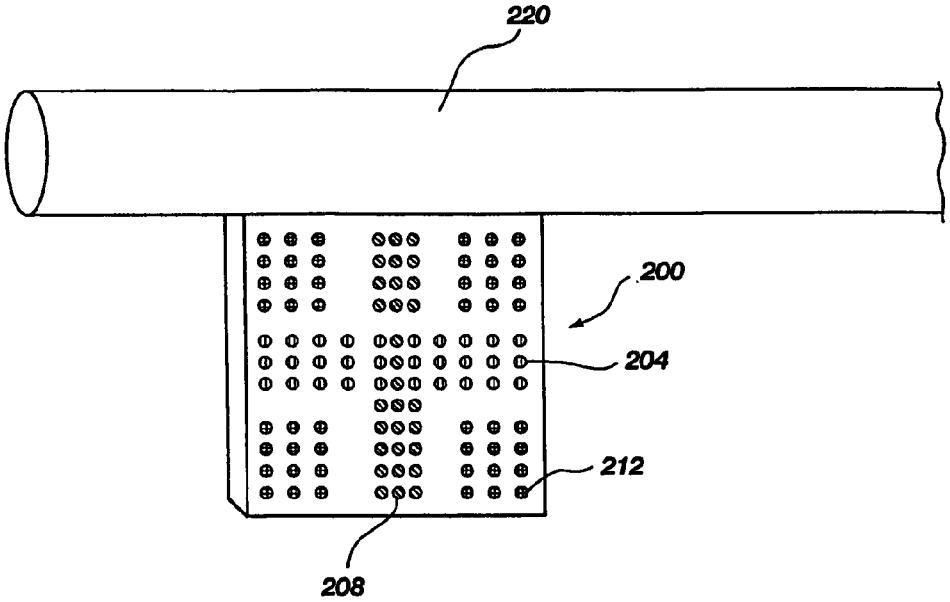
FIG. 13 shows a perspective view of yet another embodiment of a stop light array formed in accordance with the principles of the present invention.

FIG. 13 shows a perspective view of yet another embodiment of a stop light array formed in accordance with the principles of the present invention. The light array, generally indicated at 200, includes a first array of red LEDs 204 which are disposed in a generally horizontal configuration. It has been found that the LEDs can be spaced apart between 1 and 2 centimeters without creating a meaningful decrease in the visibility of the signal.

Also shown on the light array 200 is a second array of green LEDs 208 which are disposed in a generally vertical configuration. As the center of the array, the green LEDs 208 cross adjacent to the red LEDs 204.

The light array 200 also includes a third group of LEDs 212 which are yellow. By synchronizing the powering of the LEDs 204, 208 and 212, a single display panel can provide stop, yield and go signals. While the yellow lights are shown in FIG. 13 as being set apart from the other two groups, the use of LEDs enables the different colored LEDs to be intermixed. Thus, the yellow lights could form a circle of any other desired shape without interfering with the red and green signals produced by light arrays 204 and 208.

Another significant advantage which is offered by the use of light arrays in such a manner is that the size and weight of the traffic light can significantly reduced. A conventional traffic light uses three bulbs which are 12 inches in diameter. The support pole 220 or other support structure must be sufficiently strong to hold the lights above the street. Additionally, because the traffic lights are more than three feet long, precautions must be taken to deal with wind and other environmental conditions. Commonly, the lights are allowed to swing to avoid placing too much torque on the support pole 220. However, swinging lights obscure the traffic signal being presented and can cause accidents.

The light array 200 shown in FIG. 13 solves these problems. Due to the use of the LEDs in overlapping arrays, the light array can be limited in size to roughly 12 inches by 12 inches. Such a traffic light would dramatically reduce both the weight and torque which is placed on the support pole. It will also reduce the cost and time associated with replacing malfunctioning lights, as such a system would use 66 percent less lights than a conventional traffic light. Furthermore, it has been found that forming the red and green lights 204 and 208 into such arrays makes them highly visible without the use of Fresnel lenses. Thus, the cost and complexity of the bulbs can be reduced. Conventional traffic lights, in contrast, require such lenses to ensure that they are sufficiently bright at a variety of locations.

Figure 14:
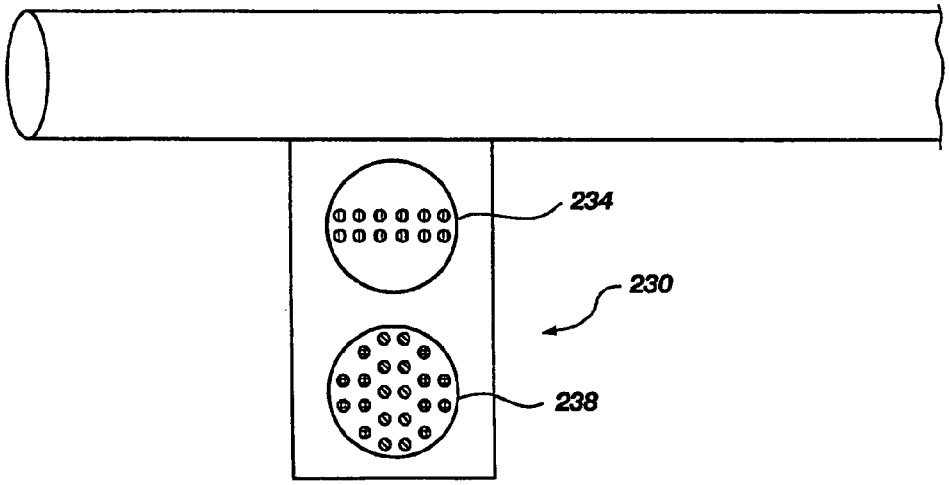
FIG. 14 shows still another embodiment of a stop light array in accordance with the principles of the present invention.

Turning now to FIG. 14, there is shown still another embodiment of a stop light array, generally indicated at 230, formed in accordance with the principles of the present invention. The light array 230 includes a first light 234 having an array of red LEDs for forming a stop signal, and a second light array 238 having green and yellow LEDs. The green and yellow LEDs operate independently to provide stop and caution signals from a common bulb. In the even that either group of lights were to malfunction, the traffic light 230 could still operate by providing either stop and go or stop and caution signals.

Figure 15:
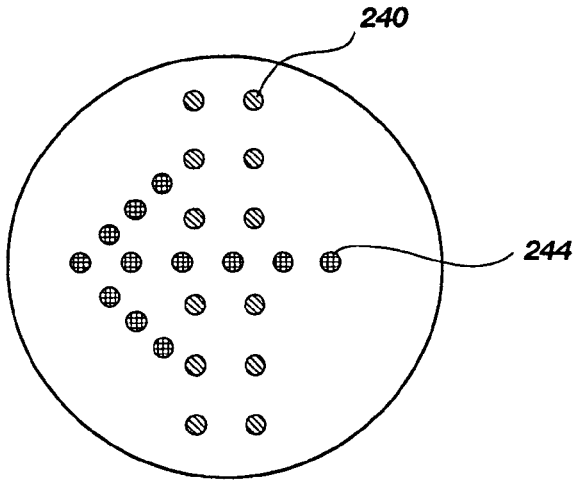
FIGS. 15 and 15A show yet other embodiments of a stop light array in accordance with the present invention.
Figure 15A:
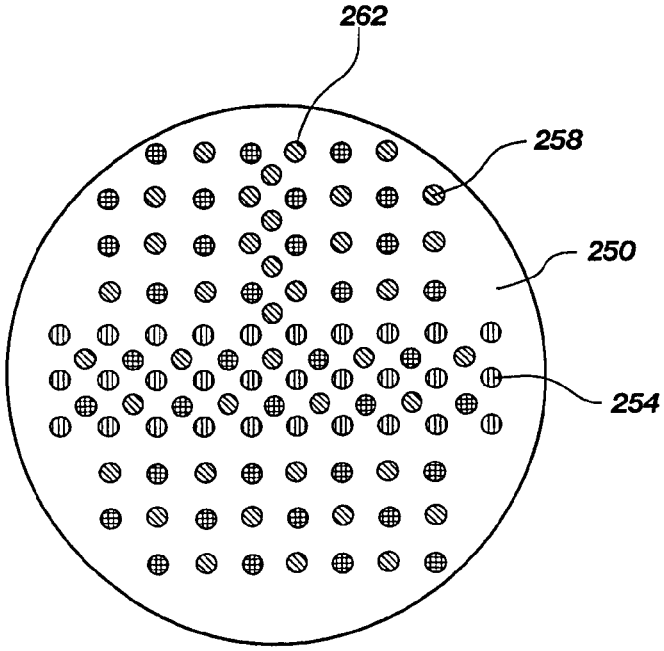

FIGS. 15 and 15A show two additional embodiments of lights in accordance with the principles of the present invention. In FIG. 15, a light is formed by two arrays of green LEDs. A first array 240, which is colored green in FIG. 15, provides a vertical bar indicating that it is safe to proceed. Based on the present disclosure, those skilled in the art will appreciate that other configurations could also be used for a signal to proceed.

A second array of lights 244 is also disposed on the light. The second array 244 is shown in yellow on FIG. 15 simply to distinguish the arrays and would typically be green. The second array 244 provides a turn arrow indicating that it is safe to turn. Thus, rather than requiring two separate traffic lights when there is an option to turn, a single light could provide separate indications for turning and for traffic passing straight through the intersection.

FIG. 15A shows still another embodiment of a light, generally indicated at 250, in accordance with the present invention. The light 250 includes an array 254 of red LEDs, and array 258 of yellow LEDs and an array 262 of green LEDs which all overlap to provide a single light which can provide signals for stop, caution and go from a single light. As explained previously, such a configuration reduces the number of lights which need to be replaced and allow traffic lights to be used more effectively in windy climates.

Thus, there is disclosed an improved Traffic Control System for controlling the flow of automobiles which makes decision making easier for red/green color blind drivers. Those skilled in the art will appreciate numerous modifications which can be made without departing from the scope and spirit of the present invention. For example, a number of other geometric shapes or light combinations can also be used for the red, yellow or green light to thereby alert drivers as to which signal is being presented without a color blind driver being forced to monitor the location of the light to determine whether the light is indicating to stop or to go. The appended claims are intended to cover such modifications.

What is claimed is:

1. A traffic control system for controlling automobile flow, the system comprising:

a stop signal consisting essentially of a red light defining a horizontal bar, the horizontal bar being at least three times greater in length than in height to enhance a distance at which the stop signal is distinguishable, the horizontal bar indicating to stop independent of a color of the red light;

a caution signal consisting essentially of a yellow light;

a go signal consisting essentially of a green light defining a vertical bar, the vertical bar being at least three times greater in length than in width to enhance a distance at which the go signal is distinguishable, the vertical bar indicating to proceed independent of a color of the green light; and wherein only one of the stop signal, the caution signal, and the go signal is lighted at a time.

2. The traffic control system of claim 1, wherein at least one of the red light, green light, and yellow light is each formed of a plurality of lights.

3. The traffic control system according to claim 1, wherein at least one of the lights comprises a secondary light with which it is associated.

4. The traffic control system according to claim 3, wherein the secondary light is of a different color than the light with which it is associated.

5. The traffic control system according to claim 1, wherein at least one of the lights has a secondary light associated with the at least one light, the secondary light being a different color than the at least one light and being illuminated along with the at least one light with which it is associated.

6. The traffic control system according to claim 5, wherein the secondary light is disposed in the horizontal bar.

7. The traffic control system according to claim 5, wherein the secondary light is disposed adjacent the horizontal bar.

8. A method for controlling automobile traffic, the method comprising:

establishing an array of lights for emitting red, yellow and green colors so as to form a traffic signal for a lane of traffic;

displaying a red horizontal bar so as to indicate to a driver that he or she may not proceed straight through an intersection, the red horizontal bar being at least three times greater in length than in height to enhance a distance at which the red horizontal bar is distinguishable, the red horizontal bar indicating to stop independent of color;

displaying a green vertical bar so as to indicate to a driver that he or she may proceed straight through an intersection, the green vertical bar being at least three times greater in length than in width to enhance a distance at which the green vertical bar is distinguishable, the green vertical bar indicating to proceed independent of color;

wherein only one of the bars is displayed at a time.

9. The method according to claim 8, wherein the red horizontal bar is the only symbol in the traffic signal which indicates that a driver may not proceed straight through the intersection.

10. The method according to claim 8, wherein the green vertical bar is the only symbol in the traffic signal which indicates that a driver may proceed straight through the intersection.

11. The method according to claim 8, wherein the method comprises disposing a vertical bar in front of at least an arrow head to indicate that a driver at the intersection may not turn.

12. The method according to claim 8, wherein the method comprises disposing a horizontal bar above or below at least an arrow head to indicate that a driver at the intersection may not turn.

13. The method according to claim 8, wherein the method comprises providing a secondary light associated with at least one of the red light, the yellow light or the green light, the secondary light being disposed in or adjacent to and a different color than the at least one of the red light, the yellow light or the green light.

14. A traffic control system for controlling automobile flow, the system comprising:

an arrow light;

a red light defining a perpendicular bar disposed perpendicular to the arrow light, the perpendicular bar being at least three times greater in length than in one of width or height to enhance a distance at which the red light is distinguishable, the perpendicular bar indicating to stop independent of a color of the red light;

a green light defining a parallel bar disposed above or below the arrow light, the parallel bar being at least three times greater in length than in one of width or height to enhance a distance at which the green light is distinguishable, the parallel bar indicating to proceed independent of a color of the green light; and wherein only one of the red light and the green light is lighted at a time.

15. A method for indicating whether an automobile can proceed through an intersection, the method comprising:

having an arrow with a shaft pointing in a direction in which the automobile is to proceed;

illuminating a bar perpendicular to the arrow shaft only when the automobile is not authorized to proceed, the perpendicular bar being at least three times greater in length than in one of width or height to enhance a distance at which the perpendicular bar is distinguishable, the perpendicular bar indicating to stop independent of a color of the perpendicular bar;

illuminating a parallel bar above or below the arrow shaft only when the automobile is authorized to proceed, the parallel bar being at least three times greater in length than in one of width or height such that the parallel bar indicates to proceed independent of a color of the parallel bar; and wherein only one of the perpendicular bar and the parallel bar is lighted at a time.

16. The method according to claim 15, wherein the method comprises disposing a bar parallel to the arrow only when the automobile is authorized to proceed.

17. The method of claim 15, wherein the bar is disposed in front of the arrow.

18. A stop light array comprising:

a red light defining a horizontal bar, the horizontal bar being at least three times greater in length than in height to enhance a distance at which the red light is distinguishable, the horizontal bar indicating to stop independent of a color of the red light;

a yellow light;

a green light defining a vertical bar, the vertical bar being at least three times greater in length than in width to enhance a distance at which the green light is distinguishable, the vertical bar indicating to proceed independent of a color of the green light;

wherein only one of the red light, the yellow light, and the green light is lighted at a time; and wherein at least one of the red light and the green light has a secondary light disposed adjacent thereto, the secondary light being a different color and being illuminated in conjunction with the light to which it is adjacent to thereby provide a secondary indication of the light which is being illuminated.

19. The stop light array according to claim 18, wherein the secondary light comprises one of a horizontal bar and a vertical bar.

20. The stop light array according to claim 18, wherein the secondary light is disposed within one of the red light and the green light.

21. The stop light array according to claim 18, wherein the secondary light forms a bar.

* * * * *